US007625295B2

(12) United States Patent
Gutierrez

(10) Patent No.: US 7,625,295 B2
(45) Date of Patent: Dec. 1, 2009

(54) WEIGHTED TRAINER GOLF CLUB

(76) Inventor: Ernesto Gutierrez, 31520 Ave El Pueblo, Cathedral City, CA (US) 92334

( * ) Notice: Subject to any disclaimer, the term of this patent is extended or adjusted under 35 U.S.C. 154(b) by 444 days.

(21) Appl. No.: 11/626,348

(22) Filed: Jan. 23, 2007

(65) Prior Publication Data

US 2008/0176667 A1 Jul. 24, 2008

(51) Int. Cl.
*A63B 53/00* (2006.01)
*A63B 69/36* (2006.01)

(52) U.S. Cl. ..... 473/256; 473/219

(58) Field of Classification Search ..... 473/219, 473/226, 256, 316
See application file for complete search history.

(56) References Cited

U.S. PATENT DOCUMENTS

| | | | |
|---|---|---|---|
| 875,273 | A | 12/1907 | Kimble |
| 1,167,387 | A | 1/1916 | Daniel |
| 1,524,196 | A | 1/1925 | Matthews |
| 1,840,924 | A | 1/1932 | Tucker |
| 1,930,342 | A | 10/1933 | Graham |
| 2,002,108 | A | 5/1935 | Child |
| 2,057,821 | A | 10/1936 | Costello |
| 2,388,463 | A | 11/1945 | Benecke |
| 2,396,408 | A | 3/1946 | Benecke |
| 2,462,955 | A | 3/1949 | Glancey |
| 2,470,816 | A | 5/1949 | Harvey |
| 2,532,646 | A | 12/1950 | Severin |
| 2,950,115 | A | 8/1960 | Hurdzan |
| 3,133,739 | A | 5/1964 | Greenshields |
| 3,136,546 | A | 6/1964 | Connolly |
| 3,194,564 | A | 7/1965 | Swan |
| 3,229,980 | A | 1/1966 | Siberman |
| 3,231,281 | A | 1/1966 | Wallo |
| 3,317,211 | A | 5/1967 | Debski |
| 3,351,346 | A | 11/1967 | Strahan |
| 3,400,933 | A | 9/1968 | Heiser |
| 3,428,325 | A | 2/1969 | Atkinson |
| 3,437,341 | A | 4/1969 | Hasten |
| 3,458,203 | A | 7/1969 | Mangis |
| 3,498,616 | A | 3/1970 | Hurst |
| 3,515,389 | A | 6/1970 | Wolfe |
| 3,680,870 | A | 8/1972 | Burnett |
| 3,716,239 | A | 2/1973 | Goudreau |
| 3,722,890 | A | 3/1973 | Wieboldt |
| 3,743,297 | A | 7/1973 | Dennis |
| 4,118,033 | A | 10/1978 | Miyamoto |
| 4,213,614 | A | 7/1980 | Philippi |

(Continued)

*Primary Examiner*—Raleigh W. Chiu
(74) *Attorney, Agent, or Firm*—Julio M. Loza; Loza & Loza, LLP

(57) ABSTRACT

A trainer golf club is provided having a hollowed shaft with a plurality of concentric weights extending along the length of the shaft for endurance training. The concentric weights may be added or removed to obtain a desired training weight for the golf club. Since the weights extend along the length of the shaft, their weight is substantially evenly distributed along the shaft which keeps the center of gravity of the trainer golf club substantially the same as that of a conventional golf club. Interchangeable golf club heads are provided that couple to one end of the trainer golf club to enable hitting golf balls. By providing multiple different types of golf club heads, the trainer golf club may be customized. Moreover, different size club heads may be coupled to a single shaft to enable a golfer to carry a set of clubs in a small, compact package.

10 Claims, 7 Drawing Sheets

U.S. PATENT DOCUMENTS

| | | | | |
|---|---|---|---|---|
| 4,444,396 | A | 4/1984 | Wendt | |
| 4,456,257 | A | 6/1984 | Perkins | |
| 4,511,147 | A | 4/1985 | Olsen | |
| 4,600,195 | A * | 7/1986 | Hunter | 473/297 |
| 4,614,343 | A | 9/1986 | Radway | |
| 4,664,388 | A | 5/1987 | Huber | |
| 4,819,935 | A | 4/1989 | Dirksing | |
| 4,819,944 | A | 4/1989 | Doane | |
| 4,889,343 | A | 12/1989 | Nielsen | |
| 4,953,868 | A | 9/1990 | Thompson | |
| 4,969,921 | A | 11/1990 | Silvera | |
| 4,982,963 | A | 1/1991 | Fazio | |
| 4,984,801 | A | 1/1991 | DeBack | |
| 5,014,984 | A | 5/1991 | Brockhoff | |
| 5,026,063 | A | 6/1991 | Rhodes | |
| 5,083,790 | A | 1/1992 | Wheatley | |
| 5,135,228 | A | 8/1992 | Hawkins | |
| 5,249,803 | A | 10/1993 | Giffin | |
| 5,330,190 | A | 7/1994 | Oakley | |
| 5,330,193 | A | 7/1994 | Ijiri | |
| 5,405,138 | A | 4/1995 | Duran | |
| 5,582,407 | A | 12/1996 | Sorenson | |
| 6,186,904 | B1 * | 2/2001 | Bass | 473/256 |
| 6,358,157 | B1 | 3/2002 | Sorenson | |
| 7,041,000 | B1 * | 5/2006 | Galloway | 473/256 |
| 2003/0224867 | A1 * | 12/2003 | Ota | 473/256 |
| 2008/0176667 | A1 * | 7/2008 | Gutierrez | 473/256 |

* cited by examiner

WEIGHTED TRAINER GOLF CLUB

BACKGROUND

1. Field

Various embodiments of the invention pertain to golf training devices and, in particular, to a weighted golf club for endurance training.

2. Background

When playing golf, it is important to swing the golf club so that that the swing path is consistent and smooth. Swing endurance training and/or muscle memory may help a golfer achieve such swing consistency. Various golf training devices have been developed to provide such endurance training. However, these endurance training devices typically cannot be used to strike a golf ball and therefore fail to provide a realistic swing experience.

Additionally, conventional golf training devices often have a fixed weight. Thus, the weight of these training devices cannot be adjusted for different golfers' needs or endurance training.

Moreover, some prior art golf training devices include a discrete weight attached to a golf club or shaft. However, such discrete weights may alter the center of gravity of the golf club, thereby causing unusual deflection, acceleration and/or motion of the golf training device. For example, by positioning the weight at one point of a golf club, the center of gravity of the golf club is significantly altered.

Some prior art golf training devices also fail to provide a realistic swing experience. That is, prior art weighted golf training devices typically have a different shape, length, and/or lack a club head with which to hit a golf ball.

U.S. Pat. No. 5,330,193, by Ijiri, describes a weighted golf training device that is shorter than a typical golf club and has a substantially symmetrical body in which different weights can be added at one end. However, this device fails to provide a realistic swing experience since it does not provide a club head with which to strike a golf ball.

U.S. Pat. No. 5,582,407, by Sorenson, discloses a golf training device having a solid steel shaft homogeneously weighted and fitted with a golf grip. However, the weight of this golf training device cannot be adjusted and does not include a club head with which to hit a golf ball.

U.S. Pat. No. 5,330,190, by Oakley Jr., discloses a golf training device having a hollow, telescoping shaft but no golf head with which to hit a golf ball.

U.S. Pat. No. 4,984,801, by DeBack, discloses a golf swing muscle strengthener that is attachable to a golf club. This device adds a weight to a conventional golf club and does not provide a realistic swing.

U.S. Pat. No. 4,969,921, by Silvera, discloses a golf training device that is mounted on a conventional golf club and includes a weight that slides within a shaft of training device to give the user a sense of increased torque as the training device is swung. However, it is not easy to adjust the weight of this device and it is separate from the golf club.

Similarly, other prior art golf club training devices fail to provide endurance training while providing a realistic golf swing.

SUMMARY

Disclosed herein is a golf club including a hollow shaft having a first end and an opening at an opposite second end. A grip is coupled at the first end of the shaft. One or more weights are insertable into the hollow shaft through the opening at the second end. The one or more weights may have a length substantially the same as the hollow shaft. In one example, the shaft may have a tubular shape and the one or more weights may be concentric weight, where one weight fits within another weight. The one or more weights may be added or removed to obtain a desired weight for endurance training. For example, a first concentric weight includes a longitudinal hollow passage or cavity that receives a second concentric weight.

A first club head may be detachably coupled to the second end of the shaft. The one or more weights may have a diameter smaller than an internal diameter of the hollow shaft. The combined length of the grip, shaft and club head may be between thirty-two and forty-five inches long, for example. A second club head interchangeable with the first club head may be included, wherein the second club head has at least one of either a different weight or shape than the first club head.

In one example, a coupler, such as a female threaded coupler, may be included at the second end of the shaft that engages the first club head to secure the first club head to the shaft. The first club head may include a threaded male fastener and the second end of the shaft corresponding to the female threaded coupler at the second end of the shaft to secure the first club head to the shaft. A security pin may also be included that passes through a first pass through hole across a diameter of the second end of the shaft and a second pass through hole in the first club head to secure the first club head to the shaft.

A tether may also be included having a first end coupled to the grip and a second end configured to be attachable to a user's wrist to secure the golf club to the user.

Another implementation provides a compact traveling golf club set. The traveling golf club set may comprise (a) a shaft having a first end and an opposite second end, (b) a grip coupled at the first end of the shaft, and (c) a first club head detachably coupled to the second end of the shaft. The first club head may be selected from a plurality of interchangeable club heads, where each golf club head has a different shape or weight than other golf club heads. In one example, the golf club may have approximately the same weight as a conventional golf club. In another example, the shaft may be hollow and has a tubular shape and one or more concentric weights are insertable into the hollow shaft through an opening at the second end. The one or more weights may have a length substantially the same as the hollow shaft, the one or more concentric weights. In one embodiment, the shaft may include multiple telescoping components that retract for compact storage and extend for use as a golf club. In another embodiment, the shaft includes multiple components that separate for compact storage and attach to each other for use as a golf club.

In one example, the first club head may include an integral threaded male fastener and the second end of the shaft includes a corresponding female threaded coupler at the second end of the shaft to secure the first club head to the shaft. In one implementation, the golf club weight may be adjusted for endurance training by replacing the first club head with a different golf club head, where the first and second golf club heads have a different weight.

DETAILED DESCRIPTION

In the following description, specific details are given to provide a thorough understanding of the embodiments. However, it will be understood by one of ordinary skill in the art that the embodiments may be practiced without these specific details.

One feature provides a trainer golf club having a hollowed shaft with a plurality of concentric weights extending along the length of the shaft for endurance training. Concentric weights may be added or removed to obtain a desired training weight. Since the weights extend along the length of the shaft, their weight is substantially evenly distributed along the shaft which keeps the center of gravity of the trainer golf club substantially the same as that of a conventional golf club.

Another feature provides interchangeable golf club heads that couple to one end of the trainer golf club to enable hitting golf balls. By providing multiple different types of golf club heads, the trainer golf club may be adjusted to a desired golf club.

Another aspect provides a compact golf club set that may include a collapsible shaft and a plurality of interchangeable club heads. Different size club heads may be coupled to a shaft of a golf club of conventional weight, size, and length. Instead of traveling with a large bag of golf clubs, this compact golf club set enables a golfer to carry a set of clubs in a small, compact package.

Figure 1:
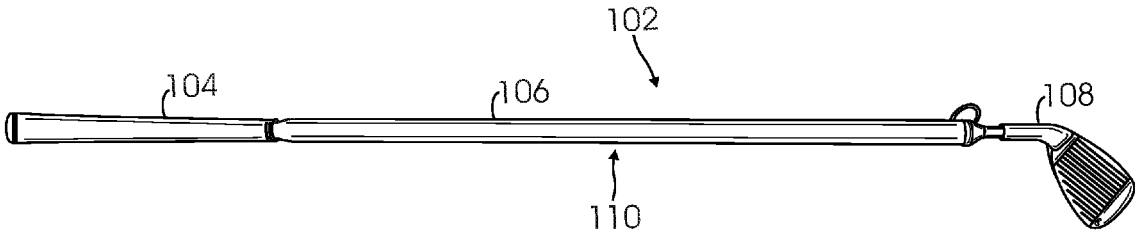
FIG. 1 illustrates a weighted trainer golf club according to one example.

FIG. 1 illustrates a weighted trainer golf club 102 according to one example. The trainer golf club 102 includes a handle 104, a shaft 106, and a club head. The handle 104 may be the shape and size of conventional golf club handles. The shaft 106 may be hollow and coupled to the handle at a first end. A second end of the shaft 106 may include an opening through which weights may be added to, or removed from, inside the hollow shaft 106. The club head 108 may have substantially the same shape and weight as conventional club heads and be removably coupled to the second end of the shaft 106.

The trainer golf club 102 may have substantially the same length as a conventional golf club. For example, the trainer golf club 102 may be between thirty-two (32) and forty-two (42) inches long. This length may be shorter or longer depending on the height of a golfer for example. Additionally, the center of gravity 110 of the trainer golf club 102 may be substantially the same as that of a conventional golf club.

Figure 2:
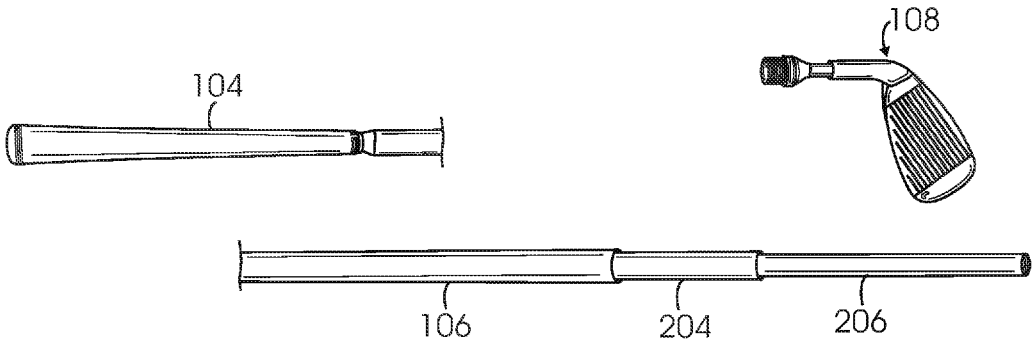
FIG. 2 illustrates an exploded view of the trainer golf club of FIG. 1.

FIG. 2 illustrates an exploded view of the trainer golf club 102 of FIG. 1. In this figure, the shaft 106 is illustrated as having a tubular cross-section and a plurality of concentric components 204, and 206. In this example, weight component 206 fits inside weight component 204 and component 204 fits inside the shaft 106. The concentric components 204 and 206 may extend the length of the shaft 106 and act as weights for endurance swing training. The concentric components 204 and 206 may have a tight fit to prevent rattling during a swing. By having the components 204 and 206 extend along the length of the shaft 106, the center of gravity of the trainer golf club 102 is substantially the same as that of a conventional golf club. Additionally, a spring and/or bushing may be inserted longitudinally on either side of the concentric components 204 and 206 inside the shaft 106 to further inhibit rattling or movement during a swing.

In one embodiment, the shaft 106 may be calibrated such that it has substantially the same weight as a conventional golf club shaft. Thus, when weight components 204 and 206 are removed, the trainer golf club 102 may weight approximately the same as a conventional golf club. However, when weight components 204 and/or 206 are inserted into the shaft 106, the trainer golf club 102 may weight several times the weight of a conventional golf club. In an alternative embodiment, the shaft 106 may weigh more than a conventional golf club shaft so that, even if the weight components 204 and/or 206 are removed, the trainer golf club 102 is still heavier than a conventional golf club and can be utilized for endurance training.

The club head 108 may be shaped and weighted like a conventional golf club head. The club head 108 may be detachable from the shaft 106 to allow removal of weight components 204 and/or 206 and/or swapping club heads having a different sizes, shapes, and/or weights.

In various embodiments, the diameter, weight, and/or shape of the shaft components 204 and 206 may be modified without departing from the invention. For example, the shaft components may have a tubular shape, elliptical cross-section, or other shape. Additionally, the flexibility, rigidity, and weight of the components 204 and/or 206 may be varied by the material(s) and/or thickness of each component. For example, a metal, composite, and/or liquid material may be used to obtain a desired flexibility and/or weight for each component 204 and/or 206.

Figure 3:
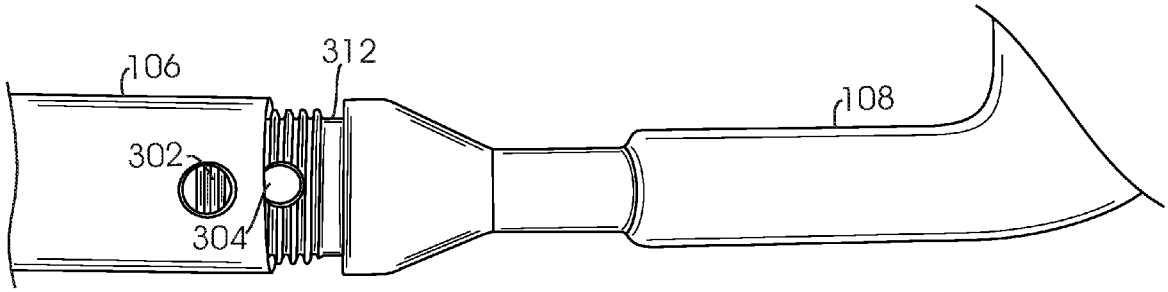
FIG. 3 illustrates how the club head of FIG. 1 may be removably coupled to the shaft according to one example.
Figure 3:
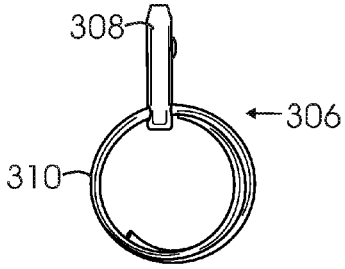

FIG. 3 illustrates how the club head 108 of FIG. 1 may be removably coupled to the shaft 106 according to one example. The club head 108 includes an integral male threaded fastener 312 that screws into a corresponding female threaded coupler at the second end of the shaft 106.

The shaft 106 may also include a first pass through hole 302 corresponding to a second pass through hole on the threaded end of the club head 108. When the club head 108 is screwed into the shaft 106, the first and second pass through holes 302 and 304 align and a retainer 306 is inserted therein to prevent the club head 108 from moving relative to the shaft 106. In one example, the retainer 306 may include a pin 308 that is sized to fit through the first and second pass through holes 302 and 304 and a pull ring 310 at a first end of the pin 308. The pin 308 may include a spring-loaded ball at a second end of the pin 308 that keeps the retainer 306 in place. The pull ring 310 may be pulled to remove the retainer 306. Other types of retainers may be used to secure the club head 108 to the shaft 106 without departing from the present invention.

Figure 4:
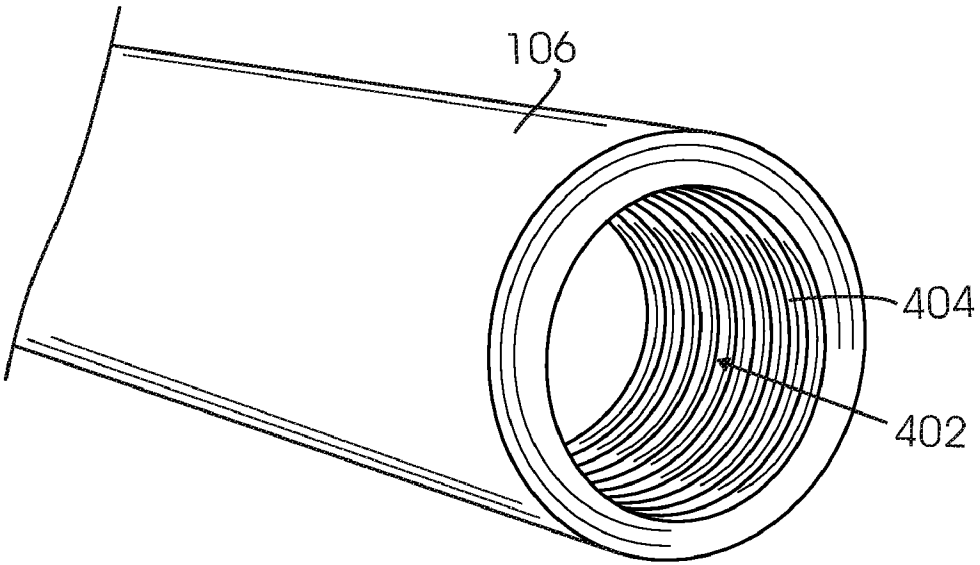
FIG. 4 illustrates a thread portion at the second end of the shaft of the trainer golf club of FIG. 1 according to one example.

FIG. 4 illustrates a thread portion at the second end of the shaft 106 of the trainer golf club of FIG. 1 according to one example. This figure illustrates an opening 402 on the second end of the shaft 106 through which components 204 and 206 can be inserted and removed. Threads 404 within the shaft 106 are configured to engage the threads on the club head 108.

Figure 5:
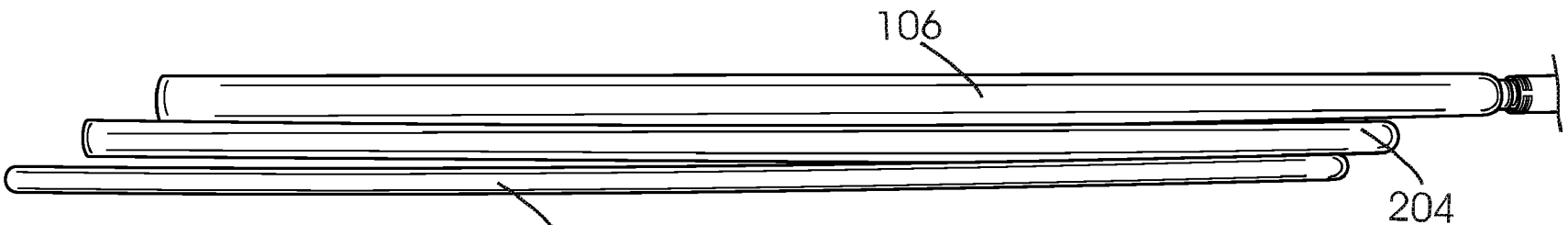
FIG. 5 illustrates one example of the shaft of the trainer golf club of FIG. 1.

FIG. 5 illustrates one example of the shaft 106 of the trainer golf club of FIG. 1. The shaft 106 includes the plurality of concentric components 204 and 206. Each concentric component 204 and 206 may have a different diameter and extends approximately the length of the shaft 106. Other embodiments may include a fewer number or greater number of weight components to allow a user to obtain a desired weight for endurance swing training.

In one example, removable club 108 head may weigh between eight (6) and sixteen (16) ounces, the shaft 106 may weigh between twenty (20) and forty (40) ounces, while the weighted concentric components 204 and 206 may each weigh between six (6) and twenty (24) ounces. Thus, in one instance, the golf club shaft 106 may have a weight greater than conventional golf club shafts and the concentric weights 204 and 206 may be selected to further increase the overall weight of the golf club.

Figure 6:
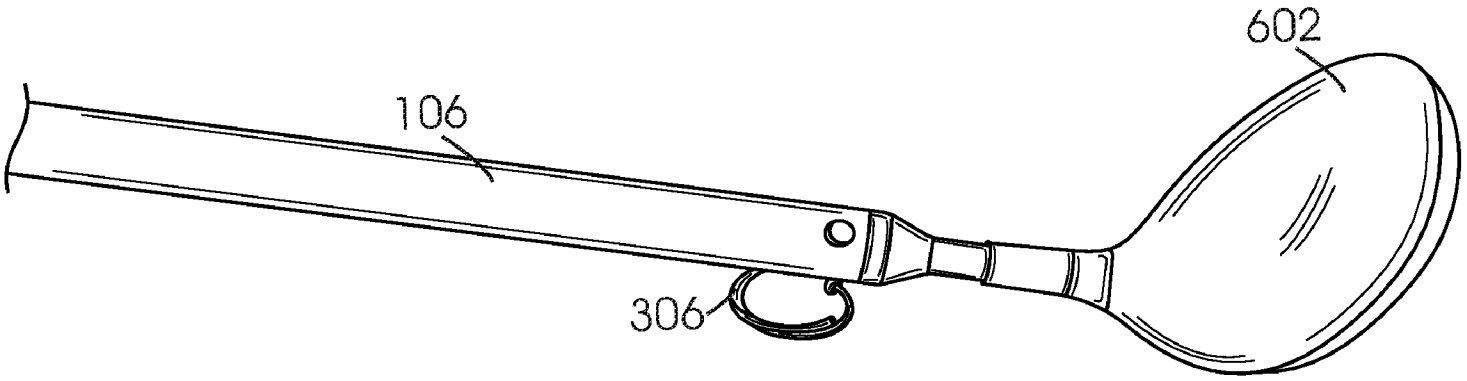
FIGS. 6 and 7 illustrate how the different club heads may be used with the trainer golf club illustrated in FIG. 1.
Figure 7:
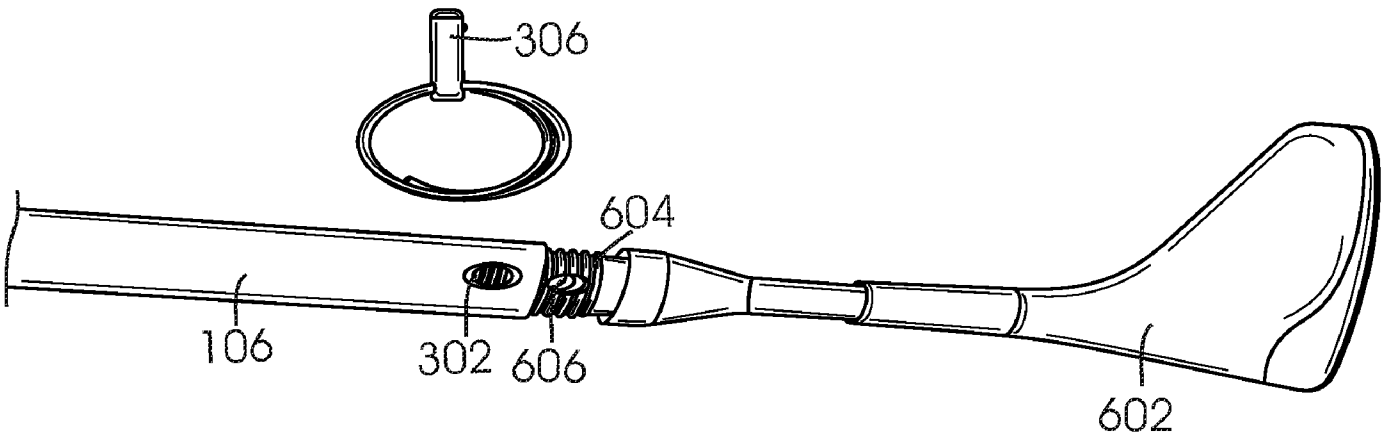

FIGS. 6 and 7 illustrate how the different club heads may be used with the trainer golf club illustrated in FIG. 1. In this example, a driver club head 602 is attached to the shaft 106 by threads 604 and secured by a retainer 306 that passes through holes 302 and 606.

The weighted trainer golf club described herein is designed to assist golfers of all levels from beginners to professionals by rapidly improving their golf swing. This adjustable weighted device closely resembles a golf club. Training with this weighted golf club may enable a golfer to eliminate an incorrect swing and teaches the golfer the proper swing path. By repeatedly swinging and or hitting range balls with this weighted trainer golf club, a golfer may increase his/her golf swing speed. This may causes the golfer to hit the golf ball longer and makes the golfer's swing less mechanical and effortless. By routinely using the weighted trainer golf club, it may strengthen all the proper muscles involved in a golfer's swing. Muscle memory will assist a golfer in retaining the proper golf swing path, follow through and golfer's posture automatically. By increasing the strength, swing speed and ball speed of a golfer, a golfer can start controlling the swing tempo in each and every swing.

The way a golfer grips a golf club, is one of the most important steps in a golf swing. The design of the weighted trainer golf club allows the golfer feel the proper way of holding a golf club during a golf swing. The adjustable weighted trainer golf club works with gravity, showing the golfer the correct swing path, which results in the golfer hitting the golf ball further and straighter. It also provides serves to warm up muscles prior to a round of golf, and provides endurance training.

Figure 8:
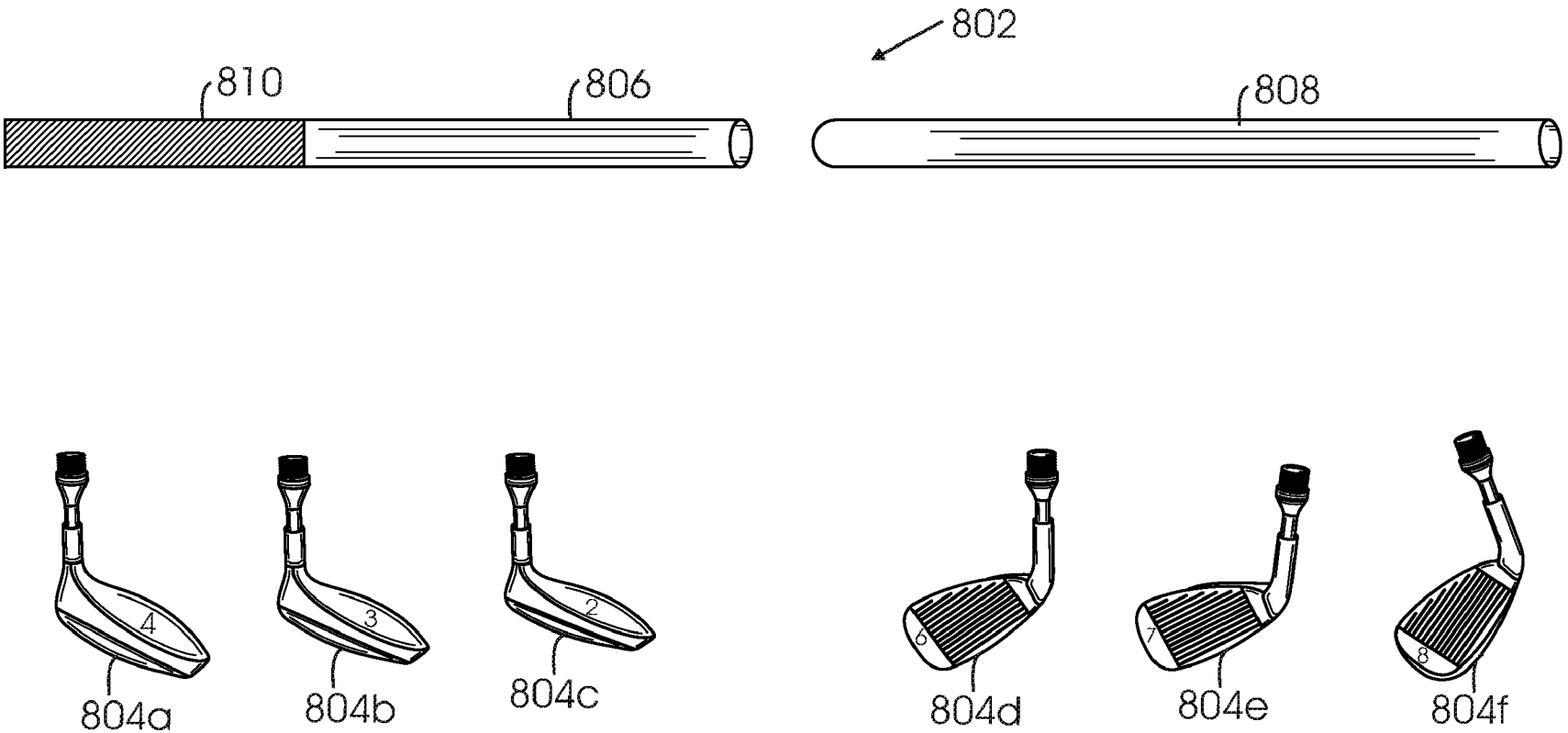
FIG. 8 illustrates a compact golf club set according to another aspect of the present invention.

FIG. 8 illustrates a compact golf club set according to another aspect of the present invention. Rather than carrying a set of bulky conventional golf clubs, the compact golf club set provides a single club shaft 802 and a plurality of different interchangeable club heads 804. The club shaft 802 may be a one-piece component or it may include multiple lengths 806 and 808 that are coupled together to form a full-length shaft or telescope outward to form the full-length shaft. The multiple lengths 806 and 808 may be detached or telescope inward to reduce the length of the shaft 802 for storage.

The club shaft 802 may include a handle or grip 810 on a first end of the shaft 802. A second end of the shaft 802 may include an attaching mechanism (e.g., threads, etc.) that allows one of a plurality of interchangeable golf club heads to be attached. In this manner, a golfer may change the golf club heads as desired for practice or a particular shot during play.

Note that the club shaft 802 may be weighted as previously described. For example, the shaft 802 (or part of the shaft) may be hollow to receive one or more concentric weights as described in FIGS. 1, 2, and 5.

In another embodiment, the club shaft 802 and grip 810 may weight approximately the same as a conventional golf club shaft and grip. However, the golf club heads 804 may be weighted for endurance training. That is, each of the golf club heads 804 may have a different weight and/or shape to allow a user to select a desired weight and/or club face type. Each of the golf club heads 804 may weigh several times more than a similar conventional golf club head. In this manner, a user may select a desirable golf club weight for endurance training while striking a golf ball. The user may quickly adjust the golf club weight by replacing the golf club head with a different golf club head.

Figure 9:
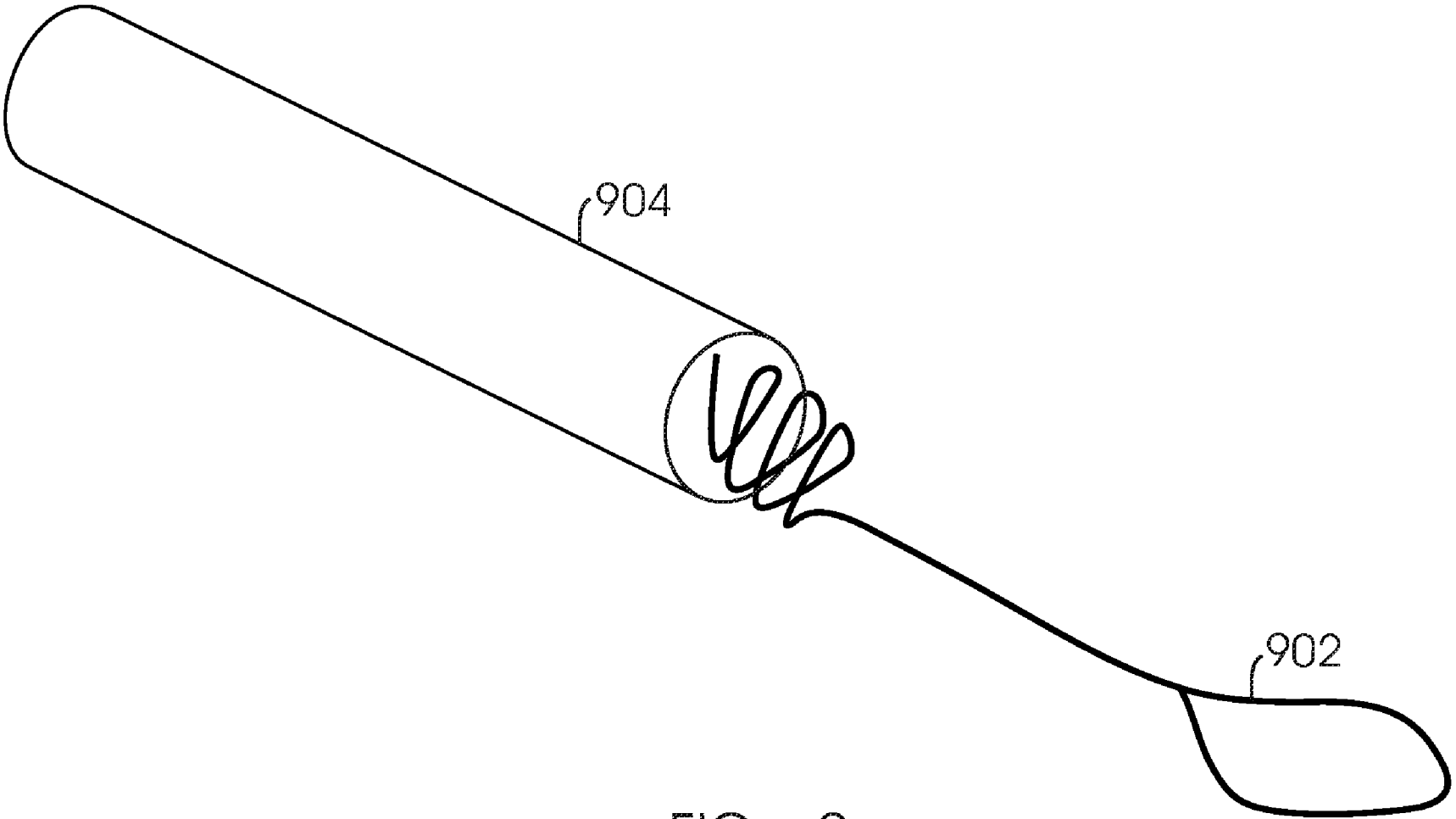
FIG. 9 illustrates a security tether for a trainer golf club.

FIG. 9 illustrates a security tether for a trainer golf club. The tether 902 may be coupled to a trainer golf club at the grip 904 and wrapped around a user's wrist. In one implementation, part of the tether 902 may be coiled within the grip and comes out when the tether 902 restrains the trainer golf club from flying out during a swing if a user loses his/her grip on the device.

Figure 10:
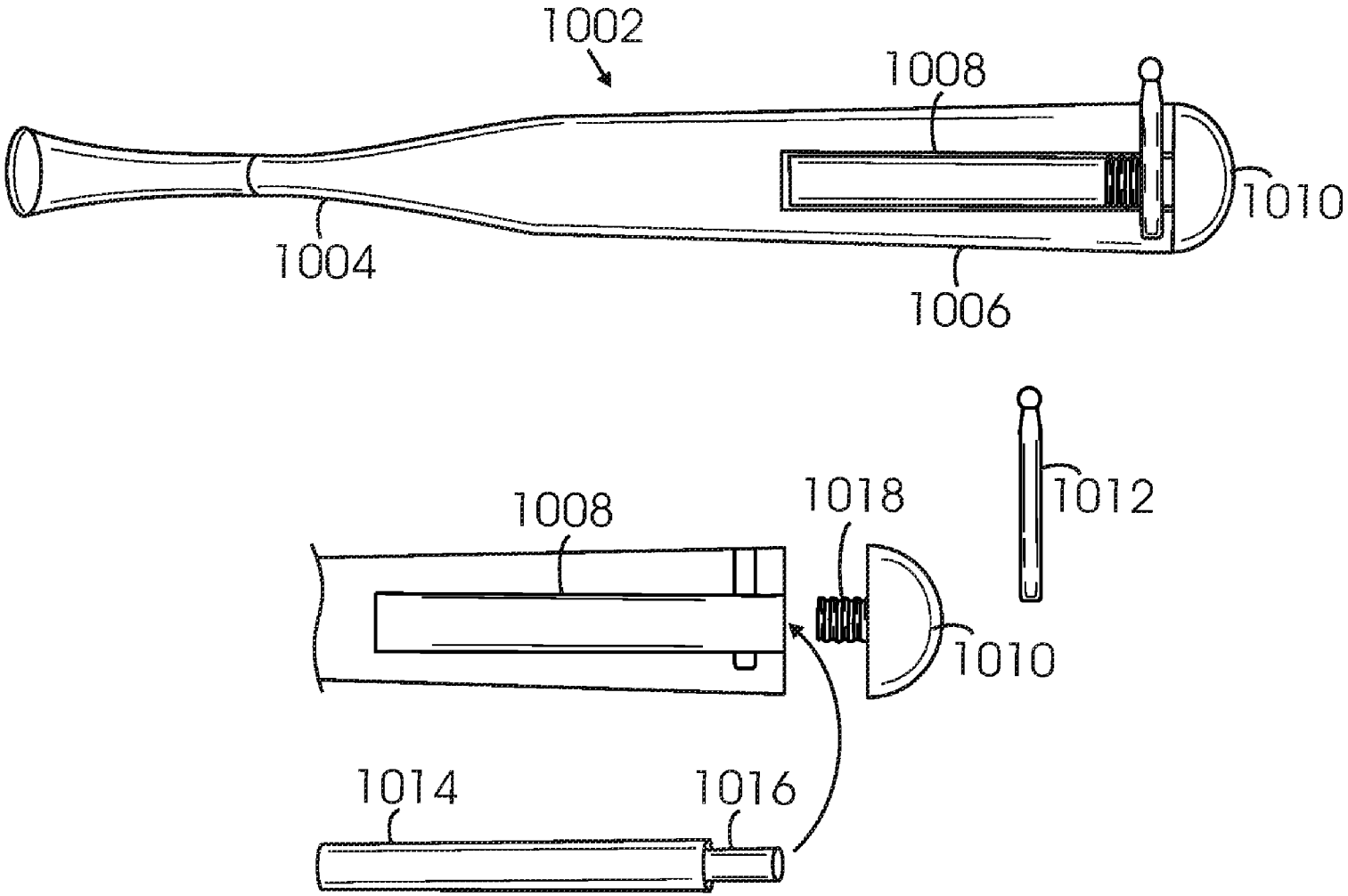
FIG. 10 illustrates a weighted baseball bat according to another embodiment of the present invention.

FIG. 10 illustrates a weighted baseball bat according to another embodiment of the present invention. The baseball bat 1002 may include a grip portion 1004 and a barrel portion 1006. The barrel portion 1006 may include a longitudinal internal cavity 1008 configured to receive one or more concentric weights 1014 and 1016. The cavity may be accessible by removing a cap 1010. The opening of the internal cavity 1008 may be threaded to receive a threaded portion 1018 of the cap 1010. The cap 1010 may serve to secure the concentric weights 1014 and 1016 inside the cavity 1008. To further secure the cap 1010 to the barrel portion 1006, a security pin 1012 passes through a hole on the side of the barrel portion 1006 and through the threaded portion 1018 of the cap 1010. The security pin 1013 and cap 1010 are removed to add or remove one or more of the concentric weights 1014 and 1016 to achieve a desired bat weight.

The concentric weights 1014 and 1016 may serve to increase the weight of the barrel portion 1006 of the bat 1002 for endurance training, warm-up, and/or develop muscle memory. One advantage of this weighted baseball bat 1002 is that it may be used to hit baseballs. In various implementations, the baseball bat 1002 may be made from aluminum, wood, and/or other materials.

From the foregoing detailed description, it will be evident that there may be a number of changes, adaptations and modifications of the present invention which come within the province of those skilled in the art. The scope of the invention includes any combination of the elements from the different species or embodiments disclosed herein, as well as subassemblies, assemblies, and methods thereof. All such variations not departing from the spirit of the invention are considered as within the scope thereof.

It should be noted that the foregoing embodiments are merely examples and are not to be construed as limiting the invention. The description of the embodiments is intended to be illustrative, and not to limit the scope of the claims.

What is claimed is:

1. A golf club, comprising:

a hollow shaft having a first end and an opening at an opposite second end;

a grip coupled at the first end of the shaft;

one or more concentric weights insertable into the hollow shaft through the opening at the second end, the one or more weights having a length substantially the same as the hollow shaft; and a first club head detachably coupled to the second end of the shaft.

2. The golf club of claim 1, further comprising:

a tether having a first end coupled to the grip and a second end configured to be attachable to a user's wrist to secure the golf club to the user.

3. The golf club of claim 1 wherein the one or more concentric weights have a diameter smaller than an internal diameter of the hollow shaft.

4. The golf club of claim 1 wherein the combined length of the grip, shaft and club head is between thirty-two and forty-five inches long.

5. The golf club of claim 1 wherein the one or more concentric weights are added or removed to obtain a desired weight for endurance training.

6. The golf club of claim 1 further comprising:

a second club head interchangeable with the first club head, the second club head having at least one of a different weight or shape than the first club head.

7. The golf club of claim 1 further comprising:

a coupler at the second end of the shaft that engages the first club head to secure the first club head to the shaft.

8. The golf club of claim 1 wherein the first club head includes a threaded male fastener and the second end of the shaft includes a corresponding female threaded coupler at the second end of the shaft to secure the first club head to the shaft.

9. The golf club of claim 1 further comprising a security pin that passes through a first pass through hole across a diameter of the second end of the shaft and a second pass through hole in the first club head to secure the first club head to the shaft.

10. The golf club of claim 1 wherein a first concentric weight includes a longitudinal hollow passage that receives a second concentric weight.

* * * * *